United States Patent [19]

Erickson et al.

[11] 4,264,269

[45] Apr. 28, 1981

[54] CENTRIFUGAL PITOT PUMP WITH IMPROVED PITOT

[75] Inventors: John W. Erickson, Huntington Beach; Carter P. Williams, La Crescenta; Vitolis Budrys, La Mirada, all of Calif.

[73] Assignee: Kobe, Inc., Huntington Park, Calif.

[21] Appl. No.: 945,540

[22] Filed: Sep. 25, 1978

[51] Int. Cl.[3] ..... F04D 1/12

[52] U.S. Cl. ..... 415/89

[58] Field of Search ..... 415/88, 89; 73/212; 233/46; 415/84

[56] References Cited

U.S. PATENT DOCUMENTS

| | | | |
|---|---|---|---|
| 2,543,242 | 2/1951 | Kent et al. | 415/88 |
| 2,680,007 | 6/1954 | Arbuckle | 415/89 |
| 3,079,070 | 2/1963 | Thylefors | 233/46 |

FOREIGN PATENT DOCUMENTS

| | | | |
|---|---|---|---|
| 1217895 | 4/1902 | France | 415/89 |

*Primary Examiner*—Louis J. Casaregola

*Attorney, Agent, or Firm*—Christie, Parker & Hale

[57] ABSTRACT

A centrifugal separator and pitot pump has a rotor driven in rotation within a casing with fluid to be cleansed of solid material entering a separation chamber of the rotor. Under a rotor imposed, centrifugal force field, solids in the fluid separate from the fluid and exit in a liquid carrier through a pitot tap close to the outer radial rotor wall. Radially interiorly of this tap, a pitot pickup intercepts cleansed production fluid and exits that fluid from the rotor. A head of a scoop of the pitot tap has an inlet in a blunt leading face and a top at the maximum radial limit of the scoop that is relieved from the leading face of the scoop to a trailing end. An inlet passage from the inlet generally parallels the line of the relief. In profile, the leading face of a scoop neck below the head curves in relief from the inlet face to a scoop base and has a relatively large radius of curvature. The leading face of the neck and base in planes normal to a radius from the axis of the rotor presents a blunt surface with curved transition corners between the middle of the face and the sides of the neck and base.

26 Claims, 9 Drawing Figures

CENTRIFUGAL PITOT PUMP WITH IMPROVED PITOT

BACKGROUND OF THE INVENTION

The present invention relates to centrifugal pumps of the pitot type and, more in particular, to an improved pitot pickup for such pumps that is particularly resistant to particle erosion.

Centrifugal pumps of the pitot type are well known. In general, these pumps include a drive that drives a rotor in rotation within a casing. A pitot pickup in a chamber of the rotor is stationary relative to the rotor and intercepts fluid within the chamber and draws that fluid from the chamber. The exiting fluid has a head larger than its inlet fluid head because of energy imparted to it by the rotor. Typically, fluid enters the rotor chamber through an annulus surrounding a pitot tube mounting tube and through a plurality of radial passages in a rotor chamber cover to exit near the outer radial limit of the chamber. The pitot inlet in the chamber may be comparatively close to the outer radial limits of the chamber, or comparatively close to the axis of rotation of the rotor, or both, depending on the application.

Centrifugal pumps of the pitot type find an application in petroleum recovery. Petroleum wells quite often employ downhole machinery to pump fluid produced by the well and fluid introduced into the well from the surface. These two fluids as pumped collectively are known as a power production fluid. The introduced fluid may be used to power downhole machinery. Typically, the downhole machinery is either a centrifugal or reciprocal engine. Power fluid for a downhole engine should be comparatively free of abrasives so that the engine is not damaged. For example, solid abrasives can erode journals and journal bearings of centrifugal machinery, in time erode blades of centrifugal machinery, and destroy seals in both types of machinery. Clearly, it is undesirable to subject downhole machinery to such a ruinous environment. Accordingly, attempts have been made to remove abrasives from the power fluid.

The problem of abrasive removal from power fluid is a continuous one. The power fluid is typically oil recovered from the well and may be in an open system where power fluid is continuously generated from well fluid. Solid contaminants abound in well fluid. Even in closed systems where power fluid circulates in a closed loop, makeup fluid for the circuit brings into it abrasive solids, and inevitable contamination with abrasive solids occurs from other sources, such as contaminated lines and leakage.

The well fluid may be multiple phase, having gas, oil and water content. Power fluid is usually single phase, either oil or water.

Centrifugal pitot pumps, usually in conjunction with other separating equipment, have been used to remove solids from power fluid streams and to separate well fluid into its phases. One technique for solid removal uses the fact that the solids are denser than fluid and employs radial exit ports in the rotor through which the solid contaminants exit the rotor chamber. Agitation vanes may be used to prevent buildup and blockage of these radial ports. When used to separate production fluid into its phases, pickups at different radii for each phase draw such phases from the rotor. These pickups may be pitot tubes.

The separation of solids from a production fluid stream through nozzles in the rotor of a pitot separator has disadvantages. When the casing outside the rotor is at atmospheric pressure, the fluid and solids entering the casing lose all their dynamic and pressure head. The fluid and solids in the typical case cannot be discharged into a collection vessel at the well. This discharge must, instead, be pumped away to some central collection area. The pump must typically raise the head of the solid and liquid discharge to several hundred pounds per square inch, say, 300 or 400 p.s.i. Sometimes it is inconvenient to provide a pump for the discharge at the well. The head lost through the nozzles could have been used to introduce the solid and liquid discharge into a flow line.

One system for separation of solids from production fluid employs a settling tank and a pitot separator. The settling tank effects phase separation by time and gravity. The pitot separator takes power fluid, say oil, from the separator and removes more solids from the stream. The pitot separator discharges separated solids and this fluid carrier back into the separator. The separator operates at flow line pressure so the discharge from the pitot separator does not suffer the large head loss that the alternative method entailed. However, the casing pressure of the pitot separator was necessarily high, and mechanical seal problems resulted.

The pitot in the path of the rotating fluid within the chamber is subjected to the erosive effect of solids carried by the fluid. The erosive effect is directly proportional to the cube of the relative velocity between the fluid and the pitot. Particularly at comparatively large radii of the chamber, the erosive effect of the solids can be startling.

Known pitot pumps includes those described in the following U.S. Pat. Nos. 3,384,024; 3,776,658; 3,795,459; 3,817,659; 3,838,939; 3,926,534; 3,960,319; 3,977,810; and 3,994,618. The pitot pickups of these patents are generally characterized by a head that extends forward toward oncoming fluid from a body. The entrance to the pitot pickup is in the head, and the material of the head surrounding the entrance may be sharp. The body below the head typically has a sharp leading edge. The surface of the head behind the entrance where cut by radial planes from the axis of the rotor is streamlined.

SUMMARY OF THE INVENTION

The present invention provides in a centrifugal pitot type pump an improved erosion resistant pitot scoop or pickup characterized by the combination of a blunt leading face surrounding the mouth or inlet to the scoop and a relief from the top of this leading face to the rear or trailing end of the head of the scoop. In a particular form, the invention provides a pitot scoop with this head, with the head extending upstream in a sense of rotor rotation from a body, and a neck of the body between the head and a base that in side elevation has a reentry curvature on its leading face of comparatively large radii of curvature.

In a detailed form, the present invention contemplates a centrifugal pump of the pitot tube type that employs a rotor having a chamber within it and driven in rotation by some prime mover, such as an electric motor. The rotor is housed within a casing. A pitot tube pickup within the chamber has the scoop with the entrance to the scoop in the leading face thereof and facing opposite the direction of rotation of the rotor to intercept fluid. The scoop preferably is made of an erosive resistant material, such as sintered carbide, and is soldered onto a leg of the pitot that opens into an exit passage that is concentric with the axis of the rotor. Inlet fluid enters the chamber through an annulus between a pitot mount, preferably a tube or duct, and a plurality of radial passages in the rotor that extend from the annulus to an exit between the radial limits of the rotor chamber. Preferably, the scoop lies close to the outer radial periphery of the rotor chamber to intercept solids at their maximum concentration. A second scoop or pickup within the rotor chamber and radially closer to the axis of rotation of the rotor than the first scoop intercepts clean fluid within the rotor. This second pickup discharges its fluid into the duct that supports both the pickup and the scoop. A concentric line or duct within the tube draws off fluid and solid material collected by the first mentioned or outer scoop.

Preferably, the scoop head for collecting solids has an inlet passage having an axis that at least approximately parallels the outer radial surface of the head. In one practical embodiment, this angle is about 7°. The outer radial surface of the head itself is slightly curved, with a comparatively large radius of curvature. The axis of the inlet passage continues from the entrance to join a radial passage that leads to discharge, preferably through the passage defined by the tube mentioned above. The entrance passage has an interior end with a spherical curvature. Diagonally from this end and at the inside corner between the entrance passage and the radial passage, a chamfered relief exists. The mouth of the inlet passage converges until it meets a cylindrical section of the inlet passage. As mentioned earlier, the leading face surrounding the mouth of the inlet is blunt. It can, in front elevation, resemble an octagon. A neck below the head and connecting the head to the base in side elevation has a reentrant curve connecting the base and the leading face of the head surrounding the mouth. This is a leading surface and it is also convexly curved in planes perpendicular to a radius of the rotor that falls within a central plane of the pitot tube. The flanks or sides of the head converge towards the posterior or trailing end of the head.

The presently preferred form of the present invention has a pitot pickup assembly of both the dirty fluid pitot pickup and the clean fluid pitot pickup. As before, the scoop that intercepts dirty fluid has the unique configuration described. It mounts at the end of an arm that tapers radially outward in a major plane normal to the axis of rotation of the rotor. It also tapers radially outward in a plane containing that axis. The arm, in cross section normal to this radius, describes an elongated symmetrical outline with sharp leading and trailing edges. A tube of the assembly has an interior end, pocketed or notched to receive the base of the arm. The notch is V-cut to develop an interference between the arm and the duct. The arm preferably attaches to the duct by welding. At about the same axial position as the dirty fluid pickup, a clean fluid pickup formed integrally with the tube extends diametrically opposite the arm. It has been found that cleaning efficiency improves by reducing the axial extent of radial facing area of stationary objects in the rotor casing. This tube, as such, partakes a known configuration and has an arm portion with sharp trailing and leading edges capped by a tube-like head that resembles a section of a torus. A passage into this clean fluid pickup directly faces a circumferential component of fluid flowing in the rotor and proceeds from this entrance through a curved transition section into a radial passage that empties into an annulus formed in a tube of the assembly and which lies concentric with the axis of rotation of the rotor. A tube concentric with this axis and extending along it communicates the dirty fluid passage with an outlet.

It has been found that with the construction of the scoop of the present invention that the life of the pitot tube has been materially increased in erosive environments. It is thought that the reason for the improvement in life lies in the control of fluid boundary layers about the pitot scoop that reduces the acceleration of particles that strike the scoop and therefore the erosive power of these particles.

These and other features, aspects and advantages of the present invention will become more apparent from the following description, appended claims and drawings.

BREIF DESCRIPTION OF THE FIGURES

DESCRIPTION OF THE PREFERRED EMBODIMENT

Figure 1:
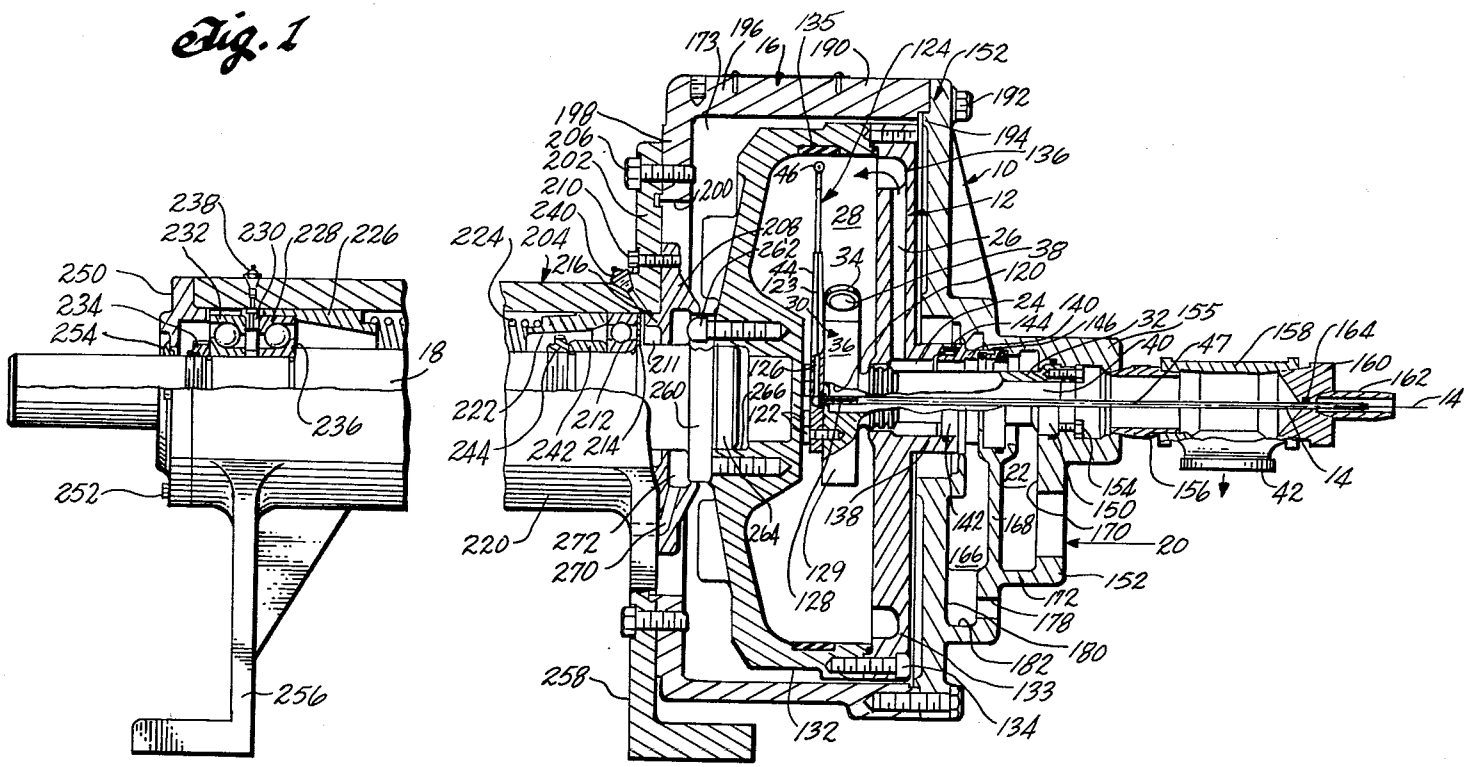
FIG. 1 illustrates in side elevation, predominantly in half section, the preferred construction of the centrifugual pitot pump with the improved scoop of the present invention.

With reference initially to FIG. 1, an improved centrifugal pitot type pump and separator 10 is illustrated. A rotor assembly 12 mounts for rotation about an axis 14 within a casing assembly 16. A prime mover, not shown, such as a motor, drives the rotor assembly through a drive shaft 18. Fluid to be pumped and cleaned enters the pump through an inlet 20, in the direction of the arrowhead on the lead line for reference numeral 20, and passes into an antechamber 22. From this chamber the fluid passes down an annulus 24 towards rotor assembly 12. A plurality of radial passages 26 of the rotor assembly open into annulus 24. These passages empty fluid into an annulus 136 at their outer radial ends to empty into a rotor chamber 28 with minimum turbulence. Rotation of the rotor assembly carries fluid in chamber 28 along with it. A pitot tube 30 within chamber 28 mounts on a duct or sleeve 32 that secures to casing 16. Pitot tube 30 includes a scoop or pickup 34 and a leg 36. An entrance 38 into scoop 34 faces fluid rotating in chamber 28 and draws this fluid from the chamber. The fluid passes into entrance 38, through the pitot tube, and along a passage 40 within duct 32. Passage 40 is concentric with axis 14. The fluid exits out an outlet 42, as indicated by the flow arrow.

A second pitot tube pickup 44 within chamber 28 and attached to duct 32 intercepts solid material accumulating at the outer radial periphery of chamber 28. A head or scoop 46 at the outer radial end of pickup 44 intercepts fluid and solids near this outer periphery and draws them off through a radial passage in the scoop and pickup and a line 47 within sleeve 32.

Generally, then, fluid enters inlet 20 and passes through annulus 24 and passages 26 into chamber 28. Within passages 26, the head of the fluid increases. Within chamber 28 the fluid increases in head and stratifies according to its density, with the densest material being radially outward of less dense material. Solids, being the densest material, tend toward the outer radial wall of chamber 28 for exit collection by pickup 44 and removal from chamber 28. The solids, of course, are in a liquid carrier. Relatively clean, solid-free fluid leaves chamber 28 through pitot tube 30 and passage 40. Solid material intercepting pitot head 46 can cause that head to erode.

The erosion intensity of solids on an object struck by the solids is generally proportional to the cube of the velocity of the solid material with respect to the object. Since the velocity of the fluid within chamber 28 increases as the radius, the erosive power of the solids suspended in the fluid increases generally as the cube of the radius of the rotor chamber. Around the entrances to the pitot tube scoops or pickups, it has been found that the erosive effect is substantial. The present invention provides an improvement in the resistance of pitot tube pickups or scoops to this erosion.

Figure 2:
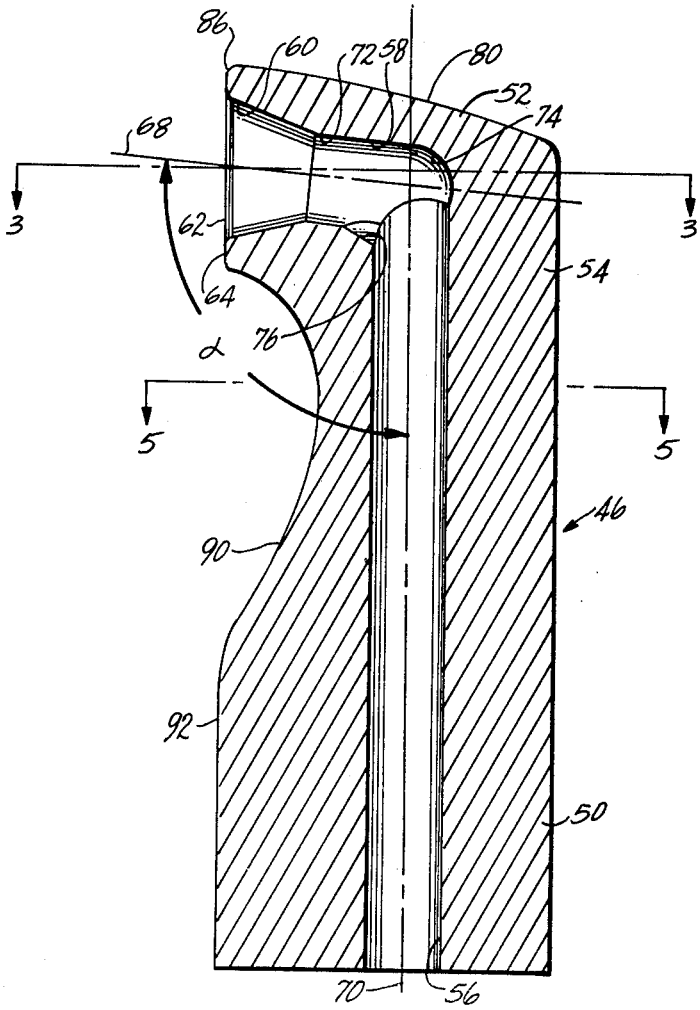
FIG. 2 illustrates in side elevational half section the preferred scoop of the construction of FIG. 1.
Figure 4:
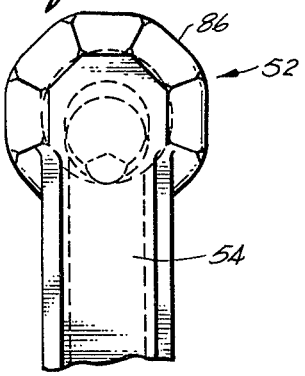
FIG. 4 is a partial view taken along 4—4 of FIG. 2 illustrating the posterior end of the head and neck of the scoop.
Figure 6:
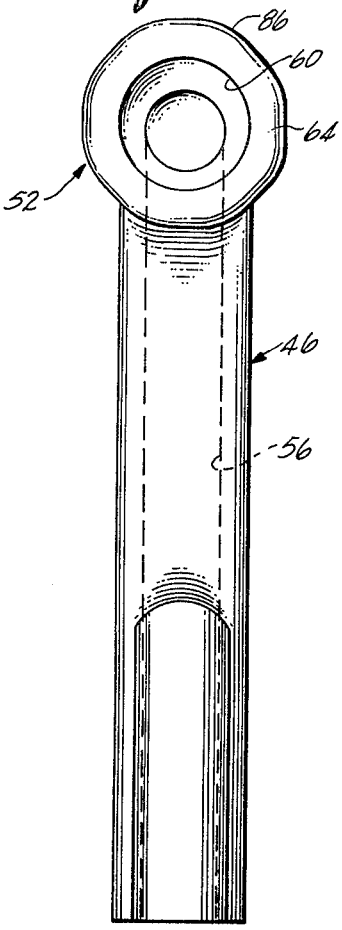
FIG. 6 is a front elevational view of the scoop of FIG. 2.

With reference to Fig. 2, head or scoop 46 is shown in side elevational half section along the central plane of the scoop. The scoop head includes a base 50, a head 52, and a connecting neck 54. The base and neck together form a body. The scoop is one piece, preferably made out of sintered carbide. it has a radial, cylindrical passage 56 that opens into an entrance passage 58. Entrance passage 58 has an axis slightly oblique to the axis of passage 56. Entrance passage 58 has a mouth 60 of frusto-conical definition that diverges to an opening 62. Opening 62 is nearly cylindrical, but is slightly ovate. A blunt leading end face or surface 64 of the head bounds opening 62. As can be seen in FIG. 6, the outer perimeter of face 64 has a general octagonal configuration with the intersecting sides of the octagon rounded. The axis of passage 58 is indicated at reference numeral 68. The axis of passage 56 is indicated by reference numeral 70. Axes 68 and 70 intercept in this embodiment at an angle alpha of 97°. Mouth 60 converges from leading end face 64 to a cylindrical passage section 72 of passage 58. A posterior end wall 74 of passage 58 has a spherical curvature with a radius of curvature corresponding to about the radius of cylindrical passage 72. Wall 74 merges into the wall of passage 56. A relief 76 is on the inside corner of the junction between passages 56 and 58 and serves to attenuate erosion at this corner.

Fluid and solids will enter mouth 60. Passing through passage 72, the velocity of the fluid increases slightly due to the decrease in cross-sectional area of the flow passage in the mouth. Fluid leaving mouth 60 will then pass into and through passage 72 to turn the 83° angle and head down passage 56 radially towards the outlet of the pump.

Figure 3:
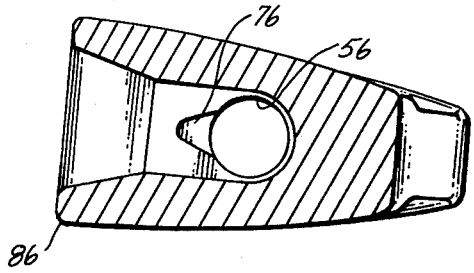
FIG. 3 is a view taken along line 3—3 of FIG. 2 illustrating the entrance passage in a major plane of the passage.
Figure 7:
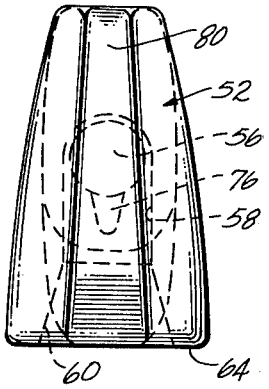
FIG. 7 is a top plan view of the scoop of FIGS. 2 through 6.

A top surface 80 of head 52 representing the outer radial limits of the scoop is inclined at an angle to axis 70 of about 97°. The outline of surface 80, however, is slightly rounded in planes radial with respect to the rotational axis of the rotor with a comparatively large radius of curvature. The curvature of surface 80 is mirrored in other external surfaces of the head, as can be seen in FIG. 3 and 7.

The octagonal periphery of leading face 64 is indicated by reference numeral 86. This perimeter represents the beginning of the relief. The relief presented by surface 80, and the similar surfaces of head 52, from periphery 86 remove these surfaces from the backwash of the turbulence effected by the blunt nose of head 52 and thereby avoids the erosive effects of solids in this backwash. The edges of the octagon can be rounded.

The provision of a blunt nose as the leading face of head 52 about entrance 62 effects a substantial cushion of stagnant fluid between the leading face of the head and the fluid in rotor chamber 28. This cushion of stagnant fluid dampens the velocity of solid particles in their course towards the leading face of the head. Consequently, these particles lose energy and when they strike the leading face their erosive impact is reduced. The cushion also diverts solids from the leading face to follow stream lines that do not intercept the leading face.

Figure 5:
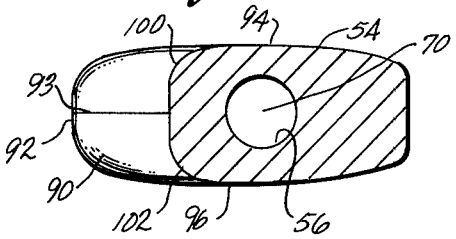
FIG. 5 is a view taken long line 5—5 of FIG. 2 illustrating the curvature of the leading face of a neck of the scoop in planes perpendicular to the axis of a radial passage of the scoop.

It has been found that the leading face of the scoop below the head is peculiary subject to the erosive effects of solids in the fluid in the rotor chamber. It has been found that these effects can be materially ameliorated by providing a reentrant or concave curved face 90 as the profile of the leading face of the neck in side elevation, as can be seen in FIG. 2. This reentrant curvature is formed of two circular arcs, with an upper arc having a radius slightly smaller than the radius of a lower arc. The reentrant curvature has large radii of curvature. The reentrant curvature sweeps downwardly from the lower portion of leading perimeter 86 towards base 50 and rearwardly toward passage 56 to about the section line for FIG. 5, then comes back out again to terminate at a line 92. As seen in FIGS. 2 and 5, an apex 93 of line 92 falls on a line passing through face 64 that is also parallel with axis 70. With continued reference to FIG. 5, neck 54 has flanks 94 and 96. The reentrant profile of FIG. 2 is maintained in all planes parallel to the central plane of the FIG. 2 section, but is somewhat softened by a fairing or rounding of leading face 90 into the flanks of the neck. The fairing curves are convex and are shown at 100 and 102, respectively, in FIG. 5. As can be seen in FIG. 5, face 90 is blunt. Flanks 94 and 96 are generally parallel in the middle of scoop 46, but neck in slightly towards the trailing end of the scoop.

It is believed that the provision of a reentrant curvature for the surface of the leading face of the neck effects a gradual deceleration of solid particles and a change in particle direction to soften the impact of the particles on the neck.

In general, then, the rotation of the rotor about the scoop and the drawing of fluid by scoop 46 from within the rotor create a pressure depression at the entrance of the scoop that attracts fluid and particles. The resulting solid concentration tends to impact the scoop about its entrance with particles and to erode the scoop. In addition to this, the entrance to the scoop may be at a large radius. Consequently, the relative velocity between the particles and the scoop can be large and the erosive power of the particles large. The geometry of the scoop of the present invention minimizes the deleterious effect of the solid content in the fluid by reducing the kinetic energy of the solids and by diverting the solids away from the scoop. Diversion is effected by blunting the leading face of the head to create a thick layer of fluid in advance of the leading face that serves to dampen solids passing through it and to create a pressure field that diverts the solids away from the leading face. Vortices formed behind the leading face separate from the head in a short distance leaving a quiescent zone of fluid adjacent the head. Any solid materials entering this zone will have their kinetic energy substantially spent, thereby negating the erosive impact of this material. The leading face of the neck is removed from the entrance to the scoop to get the face out of the zone of influence of the entrance. The leading face of the neck is rounded to avoid the erosive effect that square corners experience.

The generally octagonal shape of head 52 results from fabrication requirements of the material from which it is formed, sintered tungsten carbide. The tilting of axis 68 with respect to axis 70 maintains wall thickness between passage 72 and the outside of the head.

With reference again to FIG. 1, scoop 34 attaches to leg 36 as by welding. Leg 36 conforms in general curvature to that of base 50 and therefore is rounded at its leading face. It contains a radial passage 120 that opens into passage 40.

Pitot tube 44 attaches to sleeve 32 by a plurality of threaded fasteners 122 between the base of the pitot tube and the sleeve. The pitot tube has a basal section 123 with a feathered leading edge 123 coextensive radially with the section. The feathered leading edge reduces drag. This edge of the pitot tube terminates at an outer radial limit well below the zone affected by a substantial density of solids, the outer radial limits of chamber 28 above scoop 46. An intermediate section 124 of pitot tube 44 connects basal section 123 to scoop 46. Scoop 46 and intermediate section 124 attach by a weld. A passage 126 in the pitot tube opens into an axial passage 128 of tube 47. Passage 128 lines on axis 14. Passage 126 extends radially of the rotor through sections 123 and 124 to open into passage 56. Fluid and solids under pressure developed by the rotor pass through passages 126 and through passage 128 for collection or discharge into another line. In petroleum recovery, this line might be the flow line, and the cleansed fluid passing through pitot tube 30 could be used as power fluid for downhole machinery.

Pitot tube 30 has scoop 34 capping leg 36 and attached to the leg as by welding. A mounting base 129 of pitot tube 30 opposite leg 36 provides for the attachment of pitot tube 44.

The balance of the organization of the centrifugal pitot pump and separator of the present invention is generally known but will be presented here for completeness.

Rotor 12 consists of a deeply dished rotor drum 132 that has a cover 133 attached to it as by threaded fasteners 134. The interior of drum 132 and cover 133 define chamber 28. A urethane liner 135 on the inside wall of rotor 12 provides erosion resistance for the wall. Radial passages 26 extend in cover 133 for a substantial proportion of the cover's extent and empty into an annulus 136 at their outer radial ends. This annulus empties into rotor chamber 28. The annulus has a cross-sectional area greater than the area of the radial passages and, accordingly, the velocity of the liquid entering the rotor chamber is reduced. Furthermore, the force of the liquid on pitot pickup 44 is continuous. The annulus 24 is within a hub 138 of the cover. A seal mating ring 140 has a nose 142 received in one end of hub 138. The mating ring couples to the hub as by dowels 144. Seal mating ring 140, away from the hub, bears against an axial interior end of a seal 146. O-rings between mating ring 140, hub 138 and seal 146 prevent leakage along the interfaces between the seal mating ring on the one hand and the hub and seal on the other.

Sleeve 32 forming the most for pitot tube 30 and pitot tube 44 itself mounts coaxially to axis 14 and extends concentrically with respect to seal 146 and retaining ring 140 to define the inner wall of annulus 24 in this axial region. The end of the sleeve remote from the pitot tube has an enlarged head 150 received in a cooperating bore of a drum end 152 of casing 16. A plurality of circularly arrayed screws 154 thread into cooperating female threads in head 150 to secure the sleeve to an extension 155 of drum end 152. A nipple 156 threads into the rear end of extension 155 and receives a T-fitting 158 containing outlet 42. A reducing bushing 160 in tee 158 receives a nipple 162. Tube 47 and bushing 160 seal by an O-ring 164 between them.

Drum end 152 includes extension 155. It also defines antechamber or annulus 22 and a drain chamber 166. Antechamber 22 is bound by radial web 168 between it and chamber 166, and, on an opposite radial wall, by an exterior wall 170. An axial, annular wall 172 bounds the outside of antechamber 22. As previously described, antechamber 22 opens into axial annulus 24 for the passage of fluid into the interior of the rotor for pumping the fluid. Chamber 166 receives leakage from a chamber 173 of casing assembly 16. A drain 178 into chamber 166 passes the leakage. Chamber 166 is bound on its radial inside by radial wall 180 and on its radial outside by web 168. An axially extending annular wall 182 bounds chamber 166 on its radial outside.

A drum 190 of casing assembly 16 attaches to drum end 152 through a plurality of circularly arrayed bolts 192. A circular flange 194 locates drum end 152 on drum 190. Drum 190 has an axially extending annular wall 196 that spans the axial distance of the rotor assembly, and a radial terminal wall 198 extending from this axial wall to a large axial hole 200. A large radial wall or flange 202 of a pedestal 204 closes hole 200 and attaches to wall 198 through a plurality of circularly arrayed bolts 206. An end plate 208 attaches to wall 202 by screws 210 and forms a lubricant gallery 211 for a ball bearing 212. Bearing 212 provides a bearing support for drive shaft 18 proximate rotor assembly 12. A wave washer 214 between an annular, axially extending flange 216 of end plate 208 and bearing 212 loads the bearing. The end plate and wave washer axially locate bearing 212.

Pedestal 204 includes a sleeve 220 that receives drive shaft 18 and bearing 212. It also receives a retainer ring 222 that has a conical bore that converges toward bearing 212. This shape directs lubricant thrown against the bore wall by rotating drive shaft 18 towards the bearing. Retainer ring 222 is located against bearing 212 by a compression spring 224 that bears at its opposite end on a second retainer ring 226. This retainer ring also has a conical bore to direct lubricant against another bearing 228. Bearing 228 is for drive shaft 18. A grease gallery 230 between bearing 228 and a complementary bearing 232 provides lubrication for the two bearings. A lock nut 234 on threads of drive shaft 18 axially locates the bearings on the shaft in conjunction with a radial shoulder 236 of the shaft. Alemite fittings 238 and 240 provide the grease to galleries 230 and 211. A spacer ring 242 and a lock nut 244 on drive shaft 18 locate bearing 212.

Cover 250 attaches to the extreme end sleeve 220 as by bolts 252. A seal ring 254 seals the shaft interiorly of cover 250.

Pedestal 204 has depending legs 256 and 258 for the mounting of the centrifugal pitot pump.

Drive shaft 18, where it meets rotor assembly 12, has a radial flange 260. A plurality of circularly arrayed screws 262 bear on the flange and thread into drum 132 to secure the drive shaft to the drum. A nose 264 of drive shaft 18 pilots the drive shaft into the drum in cooperating stepped bore 266 of the drum. A drain 270 from a collection annulus 272 drains lubricant from gallery 211.

Figure 8:
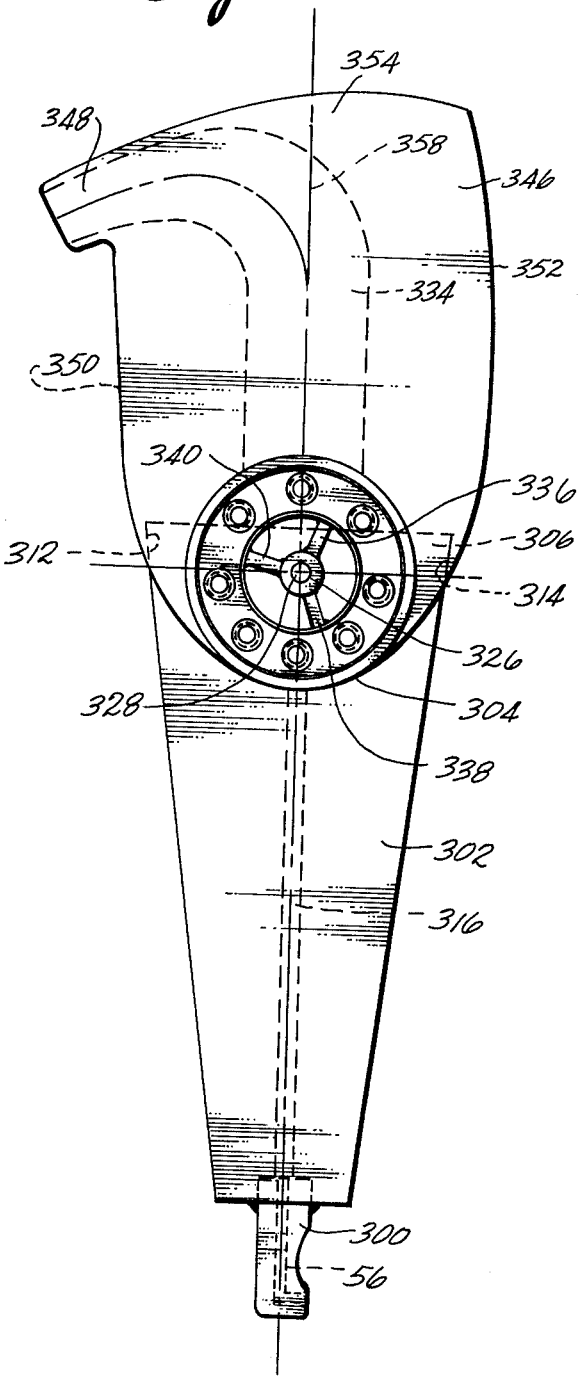
FIG. 8 is an end view of another embodiment of the scoop.
Figure 9:
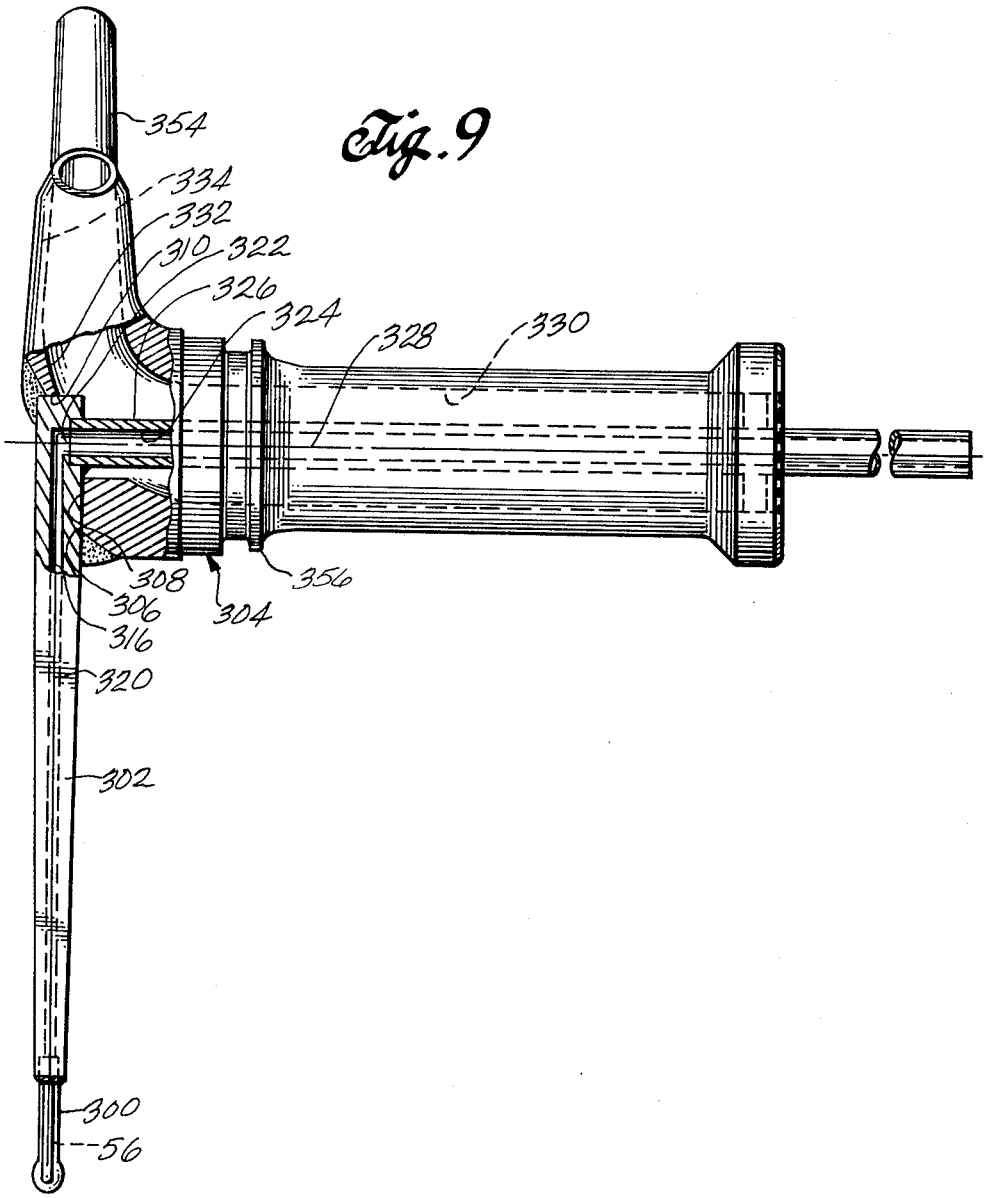
FIG. 9 is a side view partially in cross section, of the scoop of FIG. 8.

FIGS. 8 and 9 illustrate the presently preferred pitot pickups of the present invention. The pickups and attendant ducts interchange with the ones previously described and therefore the rotor assembly and casing assembly described earlier satisfactorily cooperate with the pitot tubes and ducts about to be described. A scoop 300, identical to scoop 46 previously described, attaches onto the end of a radial arm 302. Radial arm 302 attaches by welding to a tube or sleeve 304 at an interior end thereof. The sleeve has a notch 306 receiving arm 302. The walls of the notch are welded to the arm.

Arm 302 has a radial passage 316 that opens into a cooperating radial passage in scoop 300, which is identical to passage 56 of scoop 46. Scoop 300 attaches to the outer radial end of arm 302 as by a brazed bond. The leading and trailing edges of arms 302 form a sharp knife edge. One of these edges is explicitly shown by a trailing edge 320 seen in FIG. 9. The surface of the arm fairs gradually from the leading and trailing edges to a maximum arm thickness midway between the edges. Thus the outline of a cross section of arm 302 normal to passage 316 outlines an elongate structure symmetrical about its major axis with a sharp, pointed end on its major axis. Arm 302 also tapers in both end side elevations from the base of the arm at notch 306 to it outer radial end.

A stub section 322 of passage 316 opens into a passage 324 of a tube 326. Tube 326 lies on an axis 328 of tube 304. Passage 324 is concentric with axis 328. Tube 326 attaches to arm 302 by a weld. Tube 326 extends through tube 304. Tube 304 has an annular passage 330 concentric with axis 328 for its major extent. Passage 330, in the proximity of arm 302, turns gradually from axial to radial in a curved section 332. This section also decreases progressively in cross section. Transition passage 332 becomes primarily radial at 334.

As seen in FIG. 8, tube 326 mounts to tube 304 at the end of tube 304 opposite arm 302 by three radial ribs 336, 338 and 340. These ribs attach to the wall that defines passage 330 by a weld and to the outside of tube 326 by welds.

The location of scoop 300 in the rotor chamber typically is in a zone where the radial gradient of solid material is substantial. Accordingly, the outer radial end of arm 302 does not see much solid material. The arm can be shaped to minimize drag.

The clean fluid take-off of this embodiment is shown at reference numeral 346 and is of a standard configuration. It has a passage 348 that begins facing directly into the circumferential component of fluid flow. The passage continues basically circumferentially a short distance with gradually increasing cross-sectional area. The passage then turns radially inwardly through a transition passage 358 and into radial passage 334. Cross sections of pitot pickup 346 perpendicular to a radius from axis 328 develop the elongate, streamlined surface configuration described with reference to arm 302. Thus, the leading and trailing edges of pitot pickup 346, shown at reference numerals 350 and 352, respectively, are sharp edges. A head 354 of pickup 346 is generally in the form of a section of a torus.

Tube 304 in external configuration is fundamentally the same as tube 32, with the exception of a seal ring 356. This ring serves to dissipate kinetic energy of a leakage stream from the rotor chamber into the inlet annulus and improves net positive suction head. The ring as such is the invention of another, and will not be further described.

The pitot pickups of FIGS. 8 and 9 are about at the same axial location. This location avoids having both pickups in the path of particles moving radially outward in the rotor casing and improves the cleaning efficiency of the pumps.

The present invention has been described with reference to a preferred embodiment. The spirit and scope of the appended claims should not, however, necessarily be limited to the foregoing description.

What is claimed is:

1. An improvement in a pitot tube in combination with a centrifugal pitot pump, the pump being of the type that includes a rotor assembly having a rotor, a rotor chamber, and means for being driven in rotation, the pitot tube having a leading end and a trailing end opposite the leading end, the pitot tube being in the rotor chamber and having an entrance on the leading end for intercepting fluid in the chamber and drawing such fluid from the chamber, passage means communicating with the pitot tube entrance for fluid to leave the pump through the pitot tube, and passage means for the fluid into the rotor chamber, the improvement comprising:

(a) a pitot tube scoop of the pitot tube having a head at a radial distance from the axis of rotation of the rotor assembly and a body radially inside the head with respect to such axis, the head having the entrance of the pitot tube;

(b) a blunt leading face on the leading end of the head bounding the entrance of the pitot tube;

(c) the outside surface of the head being relieved from the blunt leading face to the trailing end of the head such that the largest dimension of the head facing the fluid is at the leading face; and (d) the body having a neck adjacent the head, the neck having a leading face that is relieved beginning at about the head proximate the entrance to the scoop, the relief of the neck being defined by the leading face having a concave profile curvature beginning at about the head and progressing towards the trailing end of the scoop while progressing radially towards the axis of rotation of the rotor assembly and then progressing towards the leading end of the scoop while still progressing radially towards the axis of rotation of the rotor assembly.

2. The improvement claimed in claim 1 wherein the leading face of the neck is convexly curved in planes normal to a radius from the axis of rotation of the rotor assembly.

3. The improvement claimed in claim 1 wherein the passage means communicating with the pitot tube entrance includes a converging section that begins at the entrance and converges toward the trailing end of the scoop.

4. The improvement claimed in claim 3 wherein the passage means communicating with the pitot tube entrance includes a right cylindrical section joining the converging section, the right cylindrical section and the converging section being on a common axis that has a substantial component directed along a line between the leading and trailing ends and normal to the axis of rotation of the rotor assembly.

5. The improvement claimed in claim 4 wherein the passage means communicating with the pitot tube entrance includes a radial section opening into the right cylindrical section.

6. The improvement claimed in claim 5 wherein the axis of the right cylindrical section and the converging section of the passage means communicating with the pitot tube entrance substantially parallels the relieved surface on the outside surface of the head and defines an angle greater than 90° with the axis of the radial section.

7. The improvement claimed in claim 6 wherein the scoop is made of sintered carbide.

8. The improvement claimed in claim 1 wherein the leading face of the neck in planes normal to a radius from the axis of rotation of the rotor assembly and containing the pitot tube is convexly curved.

9. The improvement claimed in claim 8 wherein the passage means communicating with the pitot tube entrance includes a converging section that begins at the entrance and converges toward the trailing end of the scoop.

10. The improvement claimed in claim 9 wherein the passage means communicating with the pitot tube entrance includes a right cylindrical section joining the converging section, the right cylindrical section and the converging section being on a common axis that has a substantial component directed along a line between the leading and trailing ends and normal to the axis of rotation of the rotor assembly.

11. The improvement claimed in claim 9 wherein the passage means communicating with the pitot tube entrance includes a radial section opening into the right cylindrical section.

12. The improvement claimed in claim 10 wherein the axis of the right cylindrical section and the converging section of the passage means communicating with the pitot tube entrance sustantially parallels the relieved surface on the outside surface of the head and defines an angle greater than 90° with the axis of the radial section.

13. In a centrifugal pitot pump of the type having a casing; a rotor assembly in the casing having a rotor chamber; means to drive the rotor assembly in rotation about an axis of rotation with respect to the casing; a pitot tube pickup having a passage; and means to mount the pitot tube pickup in the rotor chamber so that the chamber rotates with respect to the pickup with the passage oriented to intercept fluid in the rotor chamber and pass such fluid from the chamber; an improvement in the pitot tube comprising:

(a) a scoop of the pitot tube having a leading face and a trailing end opposite the leading face, a head at the upper end of the scoop, a neck adjoining the head, and the base adjoining the neck at the end of the scoop opposite the head;

(b) the passage having a radial passage section extending radially with respect to the axis of rotation through the base and neck, and an inlet passage section opening into the radial passage section having an entrance and oriented to face fluid in the chamber;

(c) the leading face of the head bounding the entrance to the inlet passage being blunt, a relief from the perimeter of the blunt leading face towards the trailing end of the head so that the head narrows in cross section from the inlet to the trailing end of the head;

(d) the leading face of the neck having a relief merging into the blunt leading face of the head on the inner radial side thereof, the relief defining a reentrant curve in major planes along radii from the axis of rotation and through the scoop with the curve extending inward toward the radial passage section from the entrance for a distance and then extending away from the radial passage and toward the base; and (e) the surface of the neck along the leading face thereof being convexly curved in planes normal to the axis of the radial passage and intercepting the surface.

14. The improvement claimed in claim 13 wherein the neck has medial side flanks that parallel one another and rear sides that merge into the side flanks and converge towards each other as the trailing end of the scoop is approached.

15. The improvement claimed in claim 13 wherein the inlet passage section has an axis intercepting an axis of the radial passage section and defining an oblique angle therewith, the inlet passage axis substantially paralleling in a plane containing both the inlet passage section axis and the radial passage section axis the upper surface of the head of the scoop.

16. The improvement claimed in claim 14 wherein the inlet passage section has a converging section that converges from the entrance toward the trailing end of the head and a cylindrical section joining the converging section at the smallest section thereof and extending toward the trailing end of the head, the radial section opening into the cylindrical section.

17. The improvement claimed in claim 15 wherein the trailing end of the cylindrical section of the inlet passage is spherically curved and merges into the radial passage.

18. The improvement claimed in claim 16 wherein the scoop is made of sintered carbide and the surface of the head is formed of generally flat sections.

19. The improvement claimed in claim 16 wherein the centrifugal pump has a clean fluid pickup in the rotor chamber mounted for relative rotation of the rotor assembly with respect to the clean fluid pickup.

20. The improvement claimed in claim 16 wherein the trailing end of the scoop is flat.

21. The improvement claimed in claim 13 wherein the centrifugal pump has a clean fluid pickup pitot tube in the rotor chamber mounted for relative rotation of the rotor assembly with respect to the clean fluid pickup pitot tube.

22. The improvement claimed in claim 20 wherein the neck has medial side flanks that parallel one another, and relieved rear sides joining the side flanks and which converge towards the trailing end of the scoop.

23. The improvement claimed in claim 22 wherein the inlet passage section has an axis intercepting an axis of the radial passage section and defining an oblique angle therewith, the inlet passage axis substantially paralleling in a plane containing both the inlet passage section axis and the radial passage section axis the upper surface of the head of the scoop.

24. The improvement claimed in claim 23 wherein the inlet passage section has a converging section that converges from the entrance toward the trailing end of the head and a cylindrical section joining the converging section at the smallest section thereof and extending toward the trailing end of the head, the radial section opening into the cylindrical section.

25. The improvement claimed in claim 24 wherein the trailing end of the cylindrical section of the inlet passage is spherically curved and merges into the radial passage.

26. The improvement claimed in claim 22 wherein the trailing end of the scoop is flat.

* * * * *

UNITED STATES PATENT AND TRADEMARK OFFICE

CERTIFICATE OF CORRECTION

PATENT NO. : 4,264,269

DATED : April 18, 1981

INVENTOR(S) : John W. Erickson et al.

It is certified that error appears in the above—identified patent and that said Letters Patent is hereby corrected as shown below:

In the specification: Column 4, line 29, after "along" insert --line--; Column 7, line 39, "lines" should be --lies--; Column 8, line 9, "most" should be --mount--; Column 9, line 41, "it" should be --its--.

In the claims: Claim 26, column 14, line 7, "22" should be --24--.

Signed and Sealed this

*Fifth* Day of *March 1985*

[SEAL]

*Attest:*

DONALD J. QUIGG

*Attesting Officer* *Acting Commissioner of Patents and Trademarks*